United States Patent [19]

Werner

[11] Patent Number: 5,056,580

[45] Date of Patent: Oct. 15, 1991

[54] METHOD FOR PRODUCING FOUNDRY PRODUCTS WITH NOZZLE OPENINGS

[76] Inventor: Klaus Werner, Am Güterbahnhof 18, 7895 Klettgau-Erzingen, Fed. Rep. of Germany

[21] Appl. No.: 427,832

[22] PCT Filed: Jan. 30, 1989

[86] PCT No.: PCT/DE89/00049

§ 371 Date: Nov. 17, 1989

§ 102(e) Date: Nov. 17, 1989

[87] PCT Pub. No.: WO89/07024

PCT Pub. Date: Aug. 10, 1989

[30] Foreign Application Priority Data

Feb. 2, 1988 [DE] Fed. Rep. of Germany ..... 3802970

[51] Int. Cl.[5] ..... B22C 7/06

[52] U.S. Cl. ..... 164/19; 164/410; 164/234

[58] Field of Search ..... 164/6, 15, 16, 19, 200, 164/7.1, 410, 234

[56] References Cited

U.S. PATENT DOCUMENTS

| | | | |
|---|---|---|---|
| 3,099,868 | 8/1963 | Grott | 164/16 |
| 3,590,902 | 7/1971 | Walker et al. | 164/16 |
| 3,888,293 | 6/1975 | LaForet et al. | 164/16 |
| 4,284,288 | 2/1981 | Michelson | 164/16 |
| 4,467,855 | 8/1984 | Uzaki et al. | 164/16 |
| 4,540,531 | 10/1985 | Moy | 164/16 |
| 4,644,995 | 2/1987 | Goumy et al. | 164/15 |

FOREIGN PATENT DOCUMENTS

| | | | |
|---|---|---|---|
| 2232376 | 1/1975 | France | 164/16 |
| 536547 | 1/1955 | Italy | 164/16 |
| 55-014183 | 1/1980 | Japan | 164/6 |
| 57-9559 | 1/1982 | Japan | 164/16 |
| 121759 | 3/1986 | U.S.S.R. | 164/16 |

*Primary Examiner*—Kurt Rowan
*Assistant Examiner*—Rex E. Pelto
*Attorney, Agent, or Firm*—Walter C. Farley

[57] ABSTRACT

In a process for producing mouldings, into whose interior is introduced a medium, particularly for producing core boxes for core shooting, in the mould cavity are provided ventilating holes or vents which are occupied by nozzles. During the moulding of the moulded part or a core member arranged therein, particularly the core box, at least one insert is inserted, whose shape corresponds to that of the nozzle. After the moulding of the core box the insert is removed and replaced by the nozzle.

7 Claims, 1 Drawing Sheet

METHOD FOR PRODUCING FOUNDRY PRODUCTS WITH NOZZLE OPENINGS

The present invention relates to a process for producing moldings, into whose interior is introduced a molding material mixture and, particularly for producing core boxes for core shooting, in which ventilating openings or vents are provided in the mold cavity and are provided with nozzles.

Although the present invention is especially directed to the production of a core box in which a core is produced from a corresponding core sand mixture, it can also be used in other similar processes.

BACKGROUND OF THE INVENTION

An important criterion for optimum core sand mixtures is, apart from a good surface of the casting and good core stability up to the time of casting, good disintegration of the blank following casting. This significantly influences the amount of cleaning to be carried out on the rough casting. Therefore what is sought consists of core molding material mixtures which, as cores after casting, have a maximum amount of burnt molding material (detachment from the casting inner wall) and ensure a rapid residual material disintegration from the casting during jolting.

Numerous modern, efficient core shooting machines are commercially available for the production of sand cores according to various core production processes. Known core production processes are the shell molding process (Croning process), the hot box process, the cold box process, the carbon dioxide solidification process and the $SO_2$ process.

It is necessary in each of these processes, when introducing the sand mixture for the core, vents are available from which the air which must give way for core formation can escape. In certain other processes, even following core production, this is scavenged e.g. with carbon dioxide, a catalyst mist or $CO_2$, e.g. in order to bring about its complete hardening.

The corresponding bores for venting purposes or for introducing the scavenging medium are now normally occupied by nozzles, which have cross-barred slits or small holes. The corresponding recesses for the nozzles are generally drilled, which involves additional working operations. As a core box can have 100 or more nozzles, so that the core can be correctly vented throughout or sand can flow into unfavourable positions, or the core box is filled in an adequate and uniformly compressed manner, said subsequent operation is very complicated and costly.

SUMMARY OF THE INVENTION

An object of the present invention is to provide a process of the aforementioned type making it possible to obviate this disadvantage and therefore significantly facilitating and reducing the cost of the production of core boxes.

According to the invention this problem is solved in that during the molding of the molded part (core member), particularly the core box, at least one insert is used, whose shape corresponds to the nozzle, said insert being removed after the molding of the core box and replaced by the nozzle.

Thus, in the present case, it virtually constitutes a duplicate of the nozzle, which is only used during the production of the core box. It is subsequently removed and replaced by the real nozzle.

The insert can e.g. be a material which automatically dissolves. However, preference is given to the insert being made from plastic or even metal. To remove the insert, it is connected to a pressure line, which can subsequently be used as a ventilating tube. If the pressure line is placed under the pressure of a pressure medium, then the insert is shot out of its seat, so that the nozzles can be readily inserted.

It is also possible to knock the insert out of its seat and consequently within the scope of the invention the insert has a shaped-on part.

According to another embodiment of the invention the insert has a frontal blind bore with an internal thread, into which can be screwed a mating threaded pin and by means of the latter the insert can be drawn out of its seat.

The temporary fixing of the insert to the molded part or the like takes place by bonding with a high-speed adhesive, or in certain cases in self-adhesive manner.

Both the process and the inventive insert can also be used in other production processes, in which moldings are produced. These can be ceramic parts or castable or foamable plastic and casting compounds.

BRIEF DESCRIPTION OF THE DRAWINGS

Further advantages, features and details of the invention can be gathered from the following description of preferred embodiments with reference to the drawings, wherein.

DESCRIPTION OF THE PREFERRED EMBODIMENTS

Figure 1:
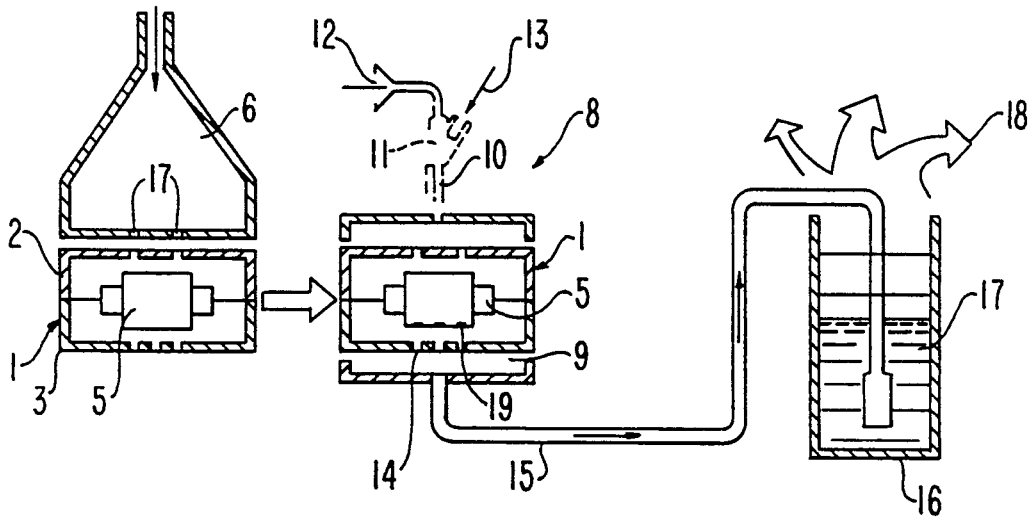
FIG. 1 is a schematic representation of a process for producing molds and cores.

FIG. 1 diagrammatically shows the cold box process, which is also known as the gas-mist process. A core box 1 having an upper part 2 and a lower part 3 contains a core 5, which is molded therein. The molding can also take place in a correspondingly inserted molding or core member.

With the core box 1 is associated a shooting head 6 of a core shooting machine (not shown). By means of corresponding shooting-in holes 7 a suitable sand mixture, e.g. dry quartz sand and liquid two-component binders, can be shot in. The core box 1 then passes into a further station 8 where it is received by a chamber 9 which is shown only schematically. Chamber 9 is supplied by means of a line 10 with a mixture of air and liquid catalyst, which are mixed together in a spraying nozzle 11. In the present embodiment air passes in the direction of arrow 12 and catalyst in the direction of arrow 13 to the spraying nozzle 11, so that complete hardening of the sand mixture takes place.

However, in order that the core box 1 is adequately supplied with the corresponding catalyst mist, nozzles 19 are generally provided towards the core 5 and each core box can contain up to 100 and more such nozzles 19. These nozzles 19 serve to better distribute the catalyst mist, as well as for venting purposes, e.g. through the corresponding vent holes 14.

In the cold box process, the catalyst mist passes through an exhaust air duct 15 into a container 16 with cleaning liquid 17. The cleaned mist can then escape into the atmosphere in accordance with arrow 18.

Following the molding of the core box 1, but prior to filling, the nozzles 19 must be inserted in the core box 1. To facilitate the insertion thereof, inserts 20 are placed or bonded in the core box 1 or molding to be produced and their dimensions correspond to those of the nozzles 19.

Figure 2:
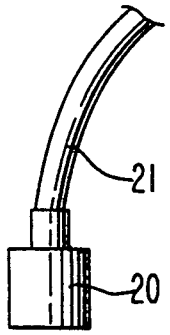
FIG. 2 is an enlarged side elevation of an insert in accordance with this invention.

In the embodiment shown in FIG. 2, insert 20 is connected to a compressed air line 21. In order to remove insert 20, compressed air is fed in via compressed air line 21 and consequently the insert 20 is shot out of its seat in the core box.

Figure 3:
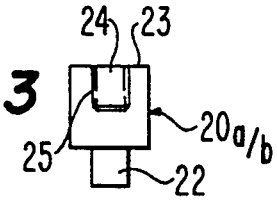
FIG. 3 is a side elevation of another embodiment of an insert in accordance with the invention.

FIG. 3 shows another embodiment of an insert 20*a*, which has a shaped-on part 22. In the use position, the latter projects from the shaped inner wall into the interior of core box 1, so that the insert 20*a* can be drawn out with a suitable tool or can be knocked out of its seat.

Figure 4:
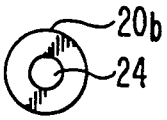
FIG. 4 is an end elevation of the insert according to FIG. 3.

FIGS. 3 and 4 also show another possible variant, where there is no need for the shaped-on part 22. In this third embodiment of an insert 20*b*, the latter is provided in its front face 23 with a blind hole 24, which has an internal thread 25, into which can be screwed a mating threaded pin and consequently insert 20*b* can be drawn out of its seat.

I claim:

1. A process for the production of moldings comprising the steps of providing means defining a mold cavity within which a molding is to be formed, inserting at least one insert member into the mold cavity, each insert member having the shape of a nozzle to be subsequently used, forming the molding in the cavity with the at least one insert member positioned so that each insert passes through an outer surface of the formed molding, removing each insert from the formed molding to thereby leave at least one vent opening in place of each insert, and inserting a nozzle into each vent opening to vent gases during subsequent processing.

2. A process according to claim 1 wherein each said insert is bonded into position during the step of inserting.

3. A process according to claim 2 wherein each said insert is connected to a pressure line for applying gas under pressure to remove the insert.

4. A process according to claim 3 wherein each said insert comprises a main body portion and a portion smaller than the main body portion and the means defining the mold cavity comprising a shell with openings dimensioned to receive the smaller portion to hold the insert in position, and wherein the step of inserting includes inserting the smaller portion of each said insert into one of the openings.

5. A process according to claim 1 wherein each said insert is connected to a pressure line and the step of removing includes applying gas under pressure to remove the insert.

6. A process according to claim 5 wherein each said insert comprises a main body portion and a portion smaller than the main body portion, the means defining the mold cavity comprising a shell with openings dimensioned to receive the smaller portion to hold the insert in position, and wherein the step of inserting includes inserting the smaller portion of each said insert into one of the openings.

7. A process according to claim 1 wherein each said insert includes means defining an internally threaded blind hole for receiving an externally threaded tool, and the step of removing includes threading a tool into the blind hole and extracting the insert.

* * * * *